US012000101B2

(12) United States Patent
Koltz et al.

(10) Patent No.: US 12,000,101 B2
(45) **Date of Patent: *Jun. 4, 2024**

(54) ROTOR FOR SNOW THROWER

(71) Applicant: The Toro Company, Bloomington, MN (US)

(72) Inventors: Paul Frederick Koltz, Chanhassen, MN (US); Brian Algot Hanson, Otsego, MN (US)

(73) Assignee: The Toro Company, Bloomington, MN (US)

( * ) Notice: Subject to any disclaimer, the term of this patent is extended or adjusted under 35 U.S.C. 154(b) by 385 days.

This patent is subject to a terminal disclaimer.

(21) Appl. No.: 17/377,908

(22) Filed: Jul. 16, 2021

(65) Prior Publication Data

US 2022/0002959 A1 Jan. 6, 2022

Related U.S. Application Data

(63) Continuation of application No. 16/230,518, filed on Dec. 21, 2018, now Pat. No. 11,066,796.

(60) Provisional application No. 62/610,788, filed on Dec. 27, 2017.

(51) Int. Cl.
*E01H 5/09* (2006.01)
*E01H 5/04* (2006.01)

(52) U.S. Cl.
CPC ..... *E01H 5/09* (2013.01); *E01H 5/045* (2013.01); *E01H 5/098* (2013.01)

(58) Field of Classification Search
CPC ..... E01H 5/09; E01H 5/045; E01H 5/098
See application file for complete search history.

(56) References Cited

U.S. PATENT DOCUMENTS

| | | | |
|---|---|---|---|
| 4,322,896 | A | 4/1982 | Miyazawa et al. |
| 4,694,594 | A | 9/1987 | Thorud et al. |
| 4,908,968 | A | 3/1990 | Thorud et al. |
| RE33,726 | E | 10/1991 | Thorud et al. |
| 5,398,431 | A | 3/1995 | Beihoffer et al. |
| 6,470,602 | B2 | 10/2002 | White et al. |
| 7,472,500 | B2 | 1/2009 | White |
| 7,624,521 | B2 | 12/2009 | White et al. |
| 9,309,638 | B2 | 4/2016 | Gilpatrick et al. |
| 9,399,846 | B2 | 7/2016 | Friberg |
| 9,546,462 | B2 | 1/2017 | Friberg et al. |

(Continued)

OTHER PUBLICATIONS

"Non-Final Office Action," for U.S. Appl. No. 16/230,518 dated Dec. 9, 2020 (12 pages).

(Continued)

*Primary Examiner* — Tara Mayo
*Assistant Examiner* — Tara Mayo-Pinnock
(74) *Attorney, Agent, or Firm* — Pauly, DeVries Smith & Deffner LLC

(57) ABSTRACT

A snow thrower includes a rotor assembly having a first auger, a second auger, and a paddle disposed between the first and second augers. The snow thrower also includes an intake housing having a first interior surface adjacent to the first auger and a second interior surface adjacent to the second auger, where an outer edge of the first auger has a clearance of less than 1 centimeter from the first interior surface across a sweep of at least 120 degrees, and an outer edge of the second auger has a clearance of less than 1 centimeter from the second interior surface across a sweep of at least 120 degrees.

20 Claims, 13 Drawing Sheets

(56) References Cited

U.S. PATENT DOCUMENTS

| | | | |
|---|---|---|---|
| 11,066,796 | B2 | 7/2021 | Koltz et al. |
| 2019/0194892 | A1 | 6/2019 | Koltz et al. |

OTHER PUBLICATIONS

"Notice of Allowance," for U.S. Appl. No. 16/230,518 dated Mar. 23, 2021 (7 pages).
"Operator's Manual," for Pro Series 21-inch Cordless Snow Blower Model iON21SB-PRO by Snow Joe, LLC. 2015 (20 pages).
"Operator's Manual," for Single Stage Snowthrower by Briggs & Stratton Power Products Group, LLC 2014 (64 pages).
"Operator's Manual," for SnowMaster 724 ZXR Snowthrower by Toro 2015 (20 pages).
"Owner's Manual," for Greenworks 80V Cordless Snow Thrower. Sep. 2, 2014 (29 pages).
"Owner's Manual," for Honda HS720A, HS720AS, HS720AM Snow Throwers. Jun. 1, 2015 (24 pages).
"Response to Non Final Office Action," for U.S. Appl. No. 16/230,518, filed Mar. 8, 2021 (9 pages).

ROTOR FOR SNOW THROWER

This application is a continuation of U.S. patent application Ser. No. 16/230,518, filed Dec. 21, 2018, which claims the benefit of U.S. Provisional Application No. 62/610,788, filed Dec. 27, 2017, the contents of which are herein incorporated by reference.

BACKGROUND

Single-stage snow throwers operate using a single rotor that rotates around a horizontal shaft. Snow incident on the front of the snow thrower is swept up by a throwing surface on the rotor and thrown out a chute at the top of the snow thrower housing. U.S. Pat. No. 4,694,594 to Thorud, herein incorporated by reference in its entirety, describes one such system. Conventional snow throwers are powered by gasoline engines, but new technology has allowed battery-powered snow throwers to come into use. Batteries, however, have a limited run time before the battery becomes depleted.

SUMMARY

One general aspect includes a snow thrower including a rotor assembly having a first auger, a second auger, and a paddle disposed between the first and second augers, the rotor assembly fixed to a shaft and the shaft configured to rotate around an axis; an intake housing having a first interior surface adjacent to the first auger and a second interior surface adjacent to the second auger; where an outer edge of the first auger has a clearance of less than 1 centimeter from the first interior surface across a sweep of at least 120 degrees, and an outer edge of the second auger has a clearance of less than 1 centimeter from the second interior surface across a sweep of at least 120 degrees.

Implementations may include one or more of the following features. The outer edge of the first auger has a clearance of less than 0.5 centimeter from the first interior surface across a sweep of at least 120 degrees. The outer edge of the first auger has a clearance of less than 1 centimeter from the first interior surface across a sweep of at least 140 degrees. The rotor assembly provides a degree of helix of greater than 180 degrees. The first interior surface has a width of at least 4 inches. The paddle has a throwing surface adjoining the first auger and the second auger. The paddle has a throwing surface, a first conveying surface, and a second conveying surface. The first conveying surface adjoins the first auger and the second conveying surface adjoins the second auger. Each auger has a conveying surface, the paddle includes a first conveying surface and a second conveying surface, and the conveying surface of the first auger adjoins the first conveying surface of the paddle and the conveying surface of the second auger adjoins the second conveying surface of the paddle. The first interior surface and the second interior surface are cylindrical. The snow thrower where the first and second augers each have a first blade and a second blade forming a double helix. The first and second augers are metal, where the paddle includes a paddle body extending from the shaft to a mid-point of a throwing surface and the paddle body is a polymer. The paddle body includes a single injection-molded structure. The paddle includes a throwing surface and an opening between the throwing surface and the shaft. The paddle includes a throwing surface and the throwing surface is angled backward compared to a direction of rotation of the rotor assembly. The paddle includes a throwing surface and the throwing surface defines an angle of at least 5 degrees from a radius of the paddle. The rotor assembly includes a throwing surface and a conveying surface, and where the throwing surface and the conveying surface share an angled edge. The pitch of the first and second augers is between about 7 inches per revolution and 12 inches per revolution. The augers have a pitch of at least about 5 inches per revolution and at most about 15 inches per revolution. The intake housing further including a first kicker and a second kicker defining a chute opening therebetween, the chute opening having a width greater than the width of a throwing surface of the rotor assembly. The kicker has a width, the first and second augers have a width, and the ratio of the kicker width to the auger width is at least 0.75.

One general aspect includes a snow thrower including a rotor assembly having a shaft, an auger having a conveying surface and an outer edge, the outer edge defining an outer diameter of the auger, and a paddle having a throwing surface adjoining the conveying surface of the auger. The snow thrower also includes an intake housing having a clearance of less than 1 centimeter from the outer diameter of the auger through at least 120 degrees of rotation of the rotor assembly.

One general aspect includes a snow thrower including an intake housing; a rotor assembly having a first auger, a second auger, and a paddle disposed between the first and second augers, the rotor assembly fixed to a shaft and the shaft configured to rotate around an axis; the paddle having a throwing surface; the first auger having a leading end adjacent to a first side of the intake housing, a trailing end adjoining the throwing surface, and a conveying surface extending between the leading end and the trailing end; the second auger having a leading end adjacent to a second side of the intake housing, a trailing end adjoining the throwing surface, and a conveying surface extending between the leading end and the trailing end; where the conveying surfaces of the first and second augers extend at least 190 degrees of helix around the axis.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense.

Figure 1:
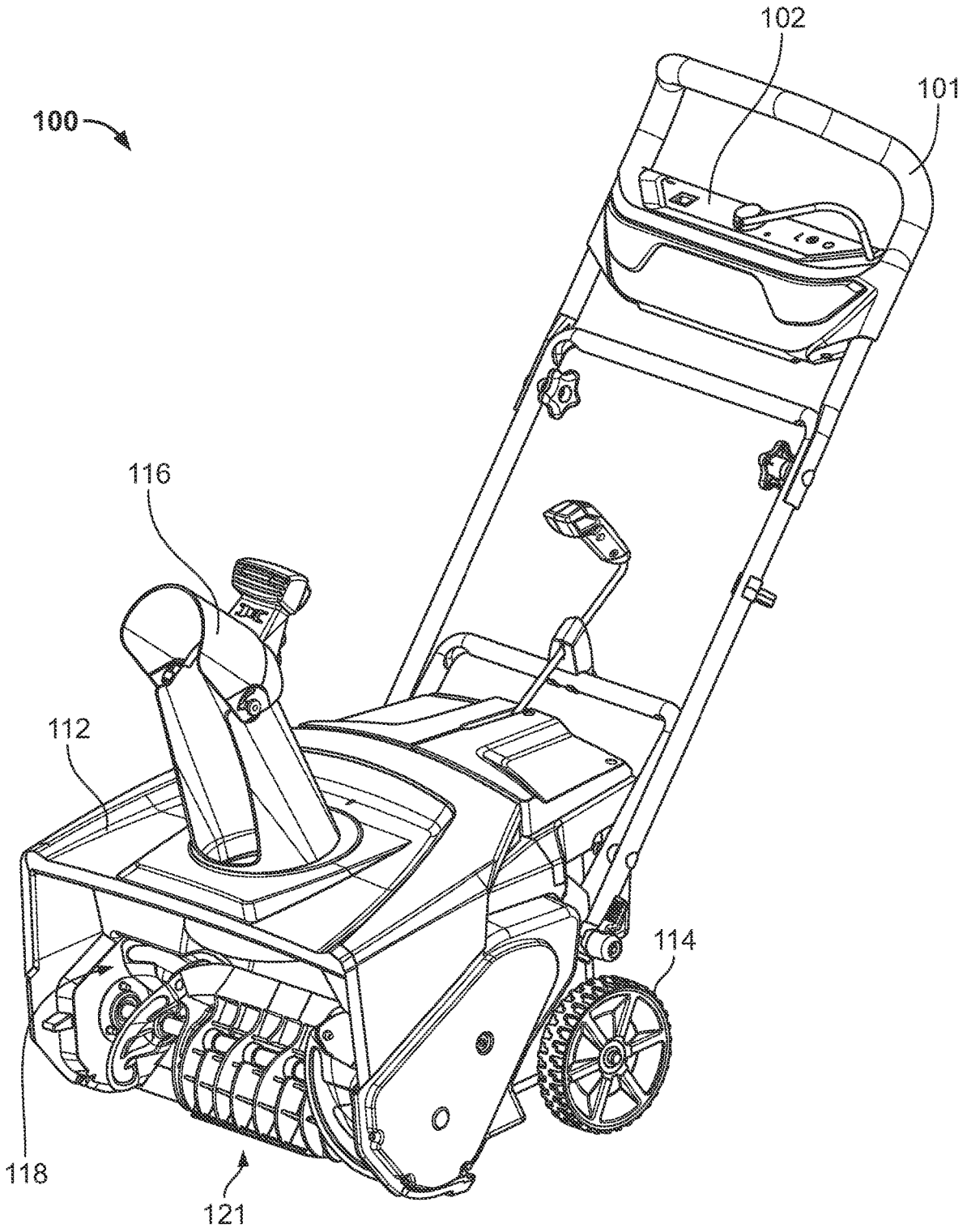
FIG. 1 is a perspective view of a snow thrower according to some examples.

While embodiments herein are susceptible to various modifications and alternative forms, specifics thereof have been shown by way of example and drawings, and will be described in detail. It should be understood, however, that the scope herein is not limited to the particular examples described. On the contrary, the intention is to cover modifications, equivalents, and alternatives falling within the spirit and scope herein.

DETAILED DESCRIPTION

A rotor assembly and housing for a single-stage snow thrower is provided. In some examples, the disclosed technology is used in a battery-powered snow thrower.

One challenge with many current designs for snow throwers is recirculation. This phenomenon occurs when snow is swept up by the snow thrower's rotor, but instead of being thrown out the chute, the snow is thrown forward, back into the path of the snow thrower. Recirculation is inefficient because the snow thrower's rotor must process the same snow multiple times. This recirculation is not detrimental in gas-powered snow throwers because gasoline engines provide sufficient power and runtime, and can throw the same snow multiple times without penalty. But for battery-powered machines, each time the snow is reprocessed, runtime is lost. Many of the examples disclosed herein reduce snow recirculation, allowing battery-powered snow throwers to clear the same amount of snow while consuming less power. Of course, the concepts are not limited to battery-powered machines and could equally be used in a gasoline-powered snow thrower.

Some designs for battery-powered single-stage rotors are constructed from a single piece of material, such as plastic or rubber. The shape of these rotors is constrained by the means of manufacturing, causing these designs to provide only a small degree of helix. As used and further discussed herein, "degree of helix" refers to the number of degrees of rotation that the rotor travels around its axis between where the extreme outer edge of the rotor reaches a reference angle (such as normal to the ground surface) to where the throwing surface reaches the reference angle. A rotor with 180 degrees of helix or less will throw the snow incident on the rotor, but not all of the snow will reach the throwing chamber and the chute. The snow that does not reach the chute instead is thrown out the front of the machine and recirculated.

The present technology provides a rotor assembly with greater than 180 degrees of helix that is able to sufficiently auger snow to the throwing chamber without recirculation. The disclosed technology provides a three-piece rotor assembly integrating metal and plastic. In some examples the rotor assembly is rigid, and it does not engage the ground.

The technology further provides kickers that hold tight clearance with portions of the rotor assembly. The kickers are formed as a contoured portion of the rear wall of the intake housing of the snow thrower. The contour conforms to the shape of the outer diameter of the rotor assembly, and the housing in combination with the rotor assembly is configured to have a clearance of 1 cm or less between the kickers and the outer diameter of the rotor assembly, which further prevents recirculation.

The technology also provides an intake housing with specific geometry to match the pitch of the augers and throwing surface. It has been found that the disclosed technology prevents recirculation of snow and improves runtime of a battery-powered snow thrower compared to previous designs.

More particularly, the rotor assembly provided herein provides a paddle with an auger on each side of the paddle. The auger blades have a steeper pitch, with less visible surface area from a front view, than the auger blades of many current models. In some examples, each auger has two auger blades shaped as a double helix. The two augers channel snow toward the center of the snow thrower housing, compacting the snow. A throwing surface of the paddle then sweeps this compacted charge of snow through a throwing chamber and out the chute. The augers provide greater than 180 degrees of helix. In some examples, an augering portion of the rotor assembly has a relatively steep pitch, the throwing surface is relatively flat, and the augering portion meets the throwing surface at an angled edge. In some examples, the paddle forms part of the conveying surface of the augering portion.

In some examples, the rotor assembly has two metal augers and a plastic paddle. The plastic paddle is rigid, but resists breaking and damage if it hits an obstacle, even at low temperatures. In some examples, the paddle has a paddle body extending from the shaft to the mid-point of the throwing surface. The paddle body can have an opening between the throwing surface and the shaft, such that snow can pass unimpeded between the shaft and the throwing surface; this additional feature can also prevent recirculation, because rotation around points near the axis of the shaft would not provide sufficient momentum for snow near the axis to be thrown out of the chute. The throwing surface of the paddle can be backwards-bladed. This changes the angle at which the snow is released from the throwing surface when the angular momentum of the rotor assembly causes the snow to be ejected out the chute.

The intake housing of the snow thrower has kickers on each side of the housing. The kickers are configured to provide a tight clearance with both augers through a wide degree of rotation of the rotor assembly around the shaft. In some examples, the kickers provide tight clearance around at least 120 degrees of rotation of the rotor assembly around the axis. In alterative examples, the kickers provide tight clearance around at least 130 degrees, at least 140 degrees, at least 150 degrees, or at least 160 degrees. In some examples, the kickers have a width of at least 75% of the width of the auger. In alternative examples, the kickers have a width that is 80%, 85%, 90%, or 95% of the width of the auger.

The intake housing has a throwing chamber defined between the two kickers. The throwing chamber has a width that is greater than the width of the throwing surface of the paddle. In some examples, the width of the throwing chamber is 5% greater, 10% greater, 15% greater, or 20% greater than the width of the throwing surface.

Turning now to the Figures, FIG. 1 is a perspective view of a snow thrower incorporating features of the disclosed technology. The snow thrower 100 has a housing 112 that houses a prime mover to operate the snow thrower. The snow thrower includes a push handle 101, operator controls 102, and wheels 114. In some examples, the snow thrower 100 is battery powered. The snow thrower 100 uses a rotor 121 to transport snow through an intake housing 118 at the front of housing 112. The snow is then discharged through a chute 116. The intake housing 118 forms an enclosure surrounding the rotor assembly 121 on multiple sides. In some examples, the rotor assembly 121 is not ground-engaging; that is, the rotor assembly 121 is intentionally elevated above the ground level such that the outside diameter of the rotor assembly 121 is not designed to touch the ground during use. A rotor assembly that is not ground-engaging will sometimes contact the ground during normal use, such as if the snow thrower is tilted forward while being pushed, but it is not designed to contact the ground when being pushed on a level surface. In alternative examples, the rotor assembly 121 could be configured to be ground-engaging. In some examples, the rotor assembly operates at least at 1,000 RPM, and as much as 2,000 RPM or greater.

Figure 2:
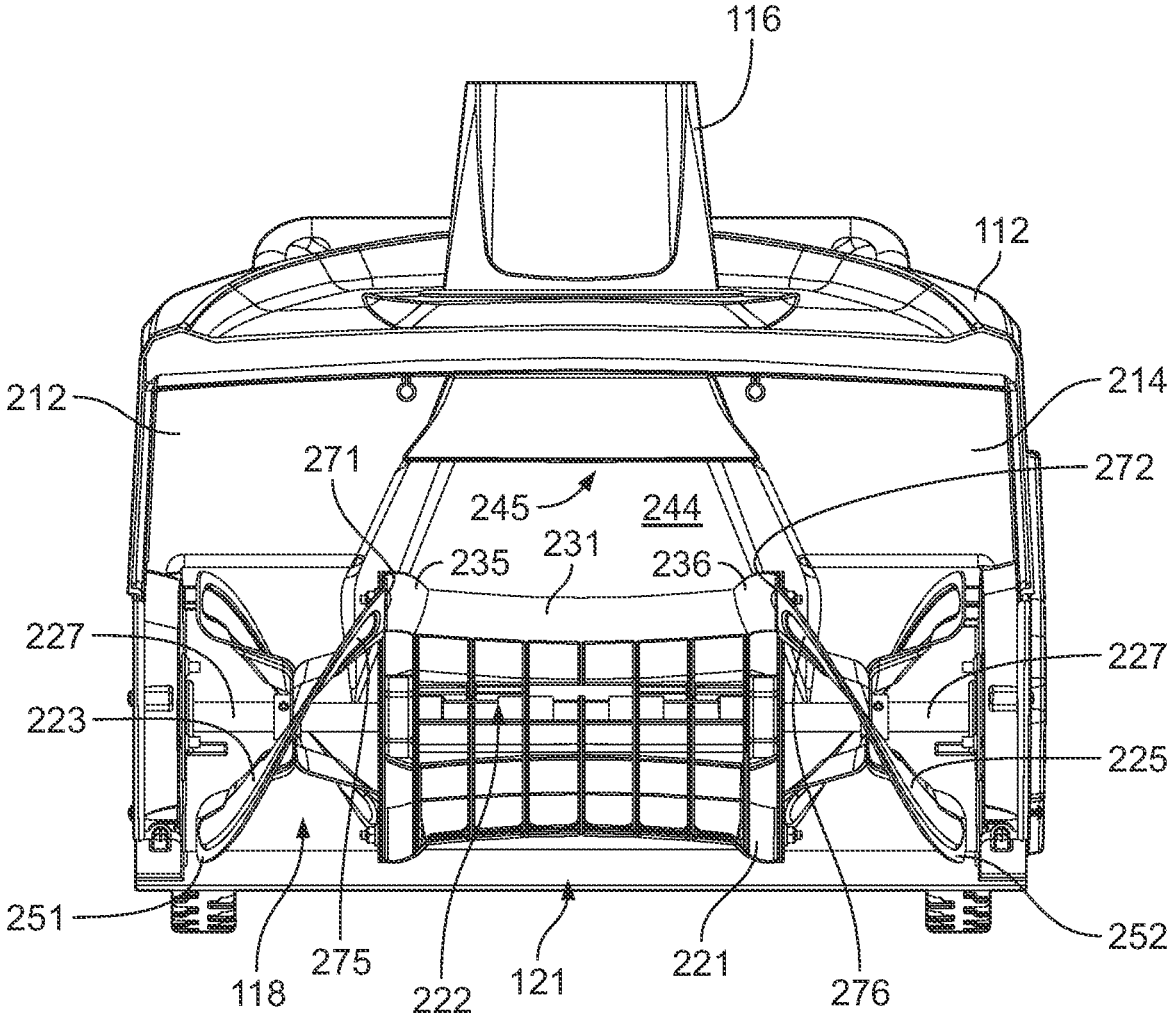
FIG. 2 is a front view of a snow thrower according to some examples.
Figure 3:
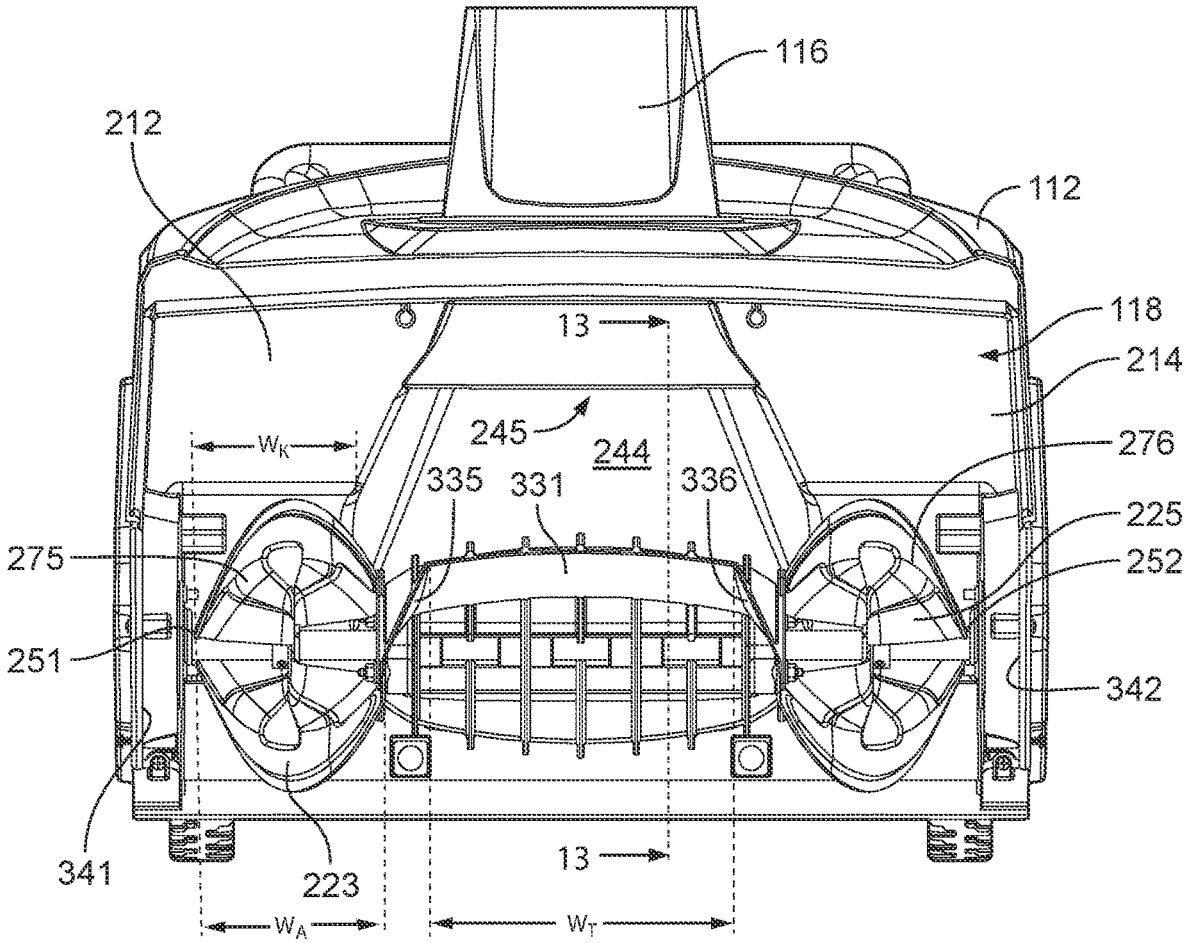
FIG. 3 is the front view of FIG. 2 showing a rotation of the rotor assembly.

FIGS. 2 and 3 show a front view of a snow thrower according to some examples. The snow thrower 100 includes the rotor assembly 121 situated within intake housing 118. In the example of FIGS. 2 and 3, the rotor assembly 121 includes a shaft 227, a paddle 221, a first auger 223, and a second auger 225. The shaft 227 defines an axis. The paddle 221, first auger 223, and second auger 225 are fixedly attached to the shaft, and rotate with the shaft 227 as the rotor assembly 121. The first auger 223 and the second auger 225 are fixedly attached to the paddle 221. FIG. 2 shows the rotor assembly 121 at a first angle of rotation around the shaft 227, and FIG. 3 shows the rotor assembly 121 at a second angle of rotation around the shaft 227.

Paddle (FIGS. 2-3, 4, & 5-6)

Figure 4:
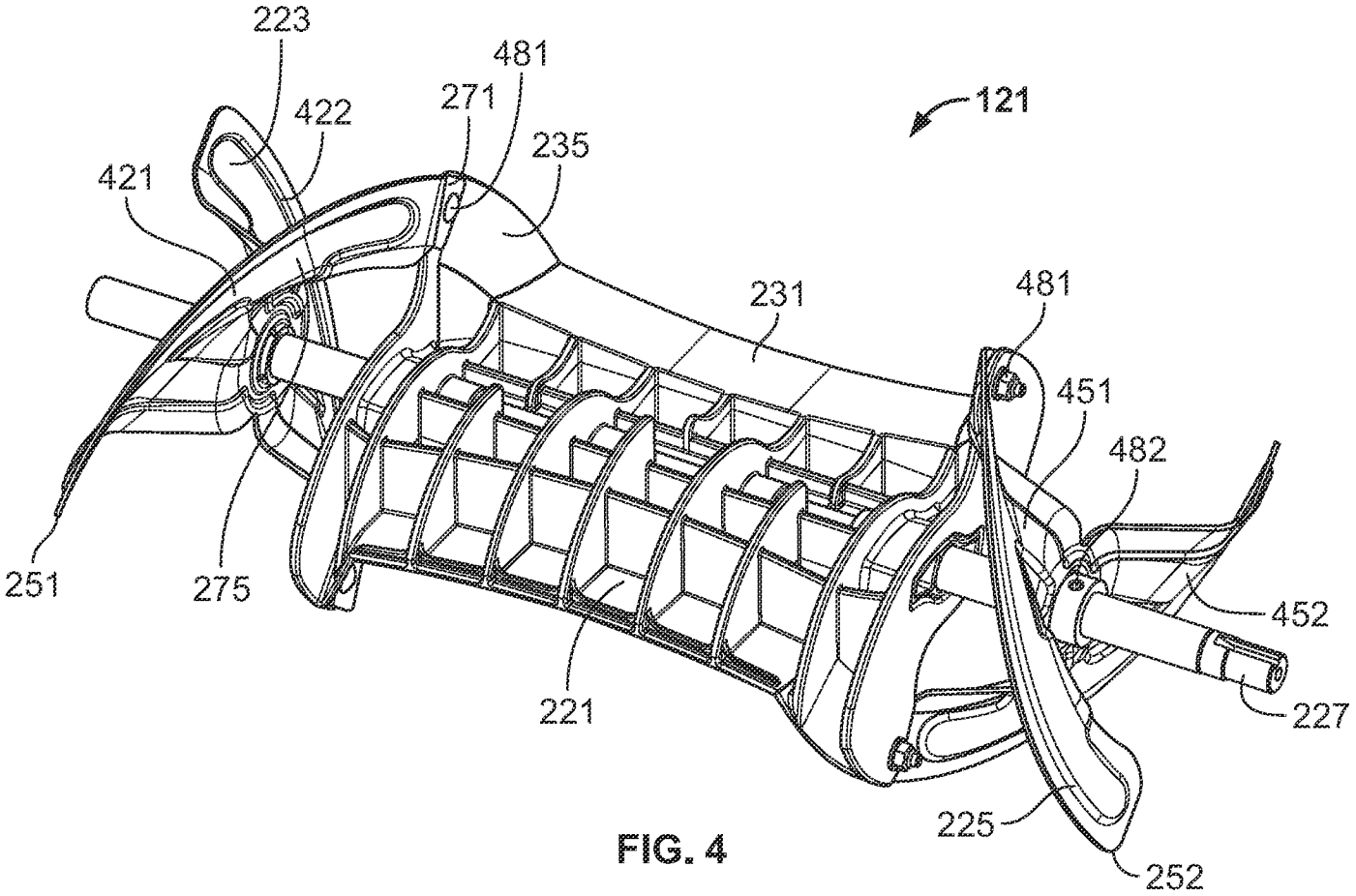
FIG. 4 is a perspective view of a rotor assembly according to some examples.
Figure 5:
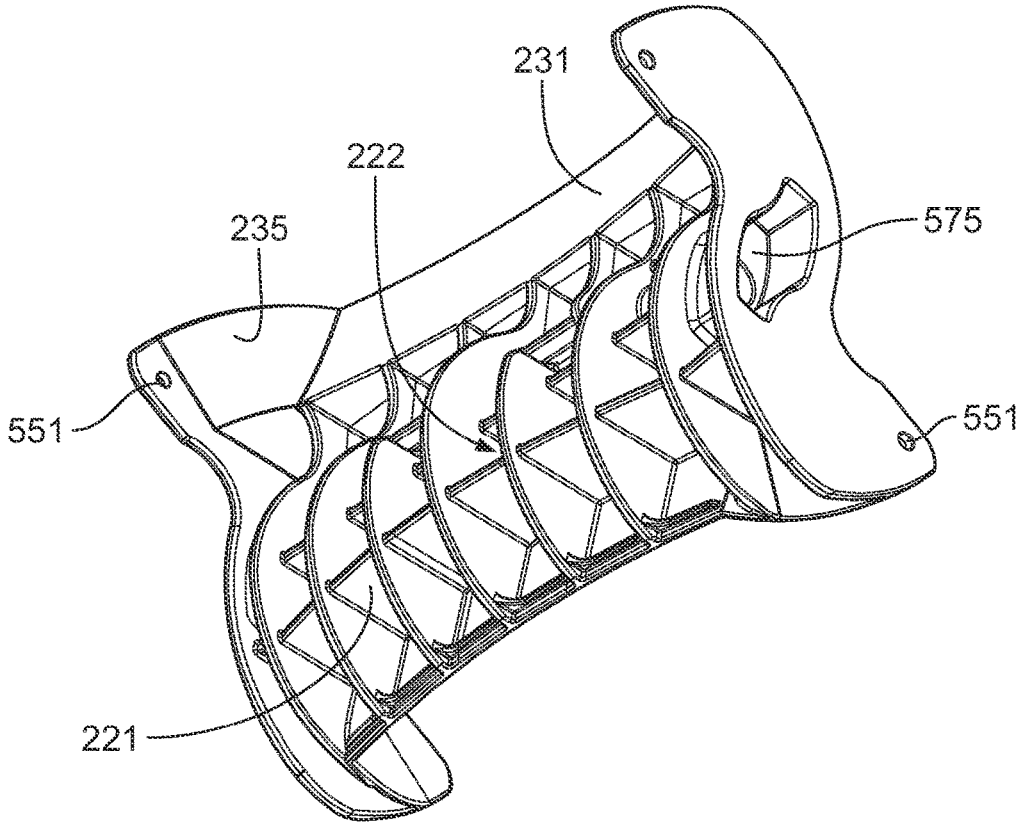
FIG. 5 is a perspective view of a paddle for a rotor assembly.
Figure 6:
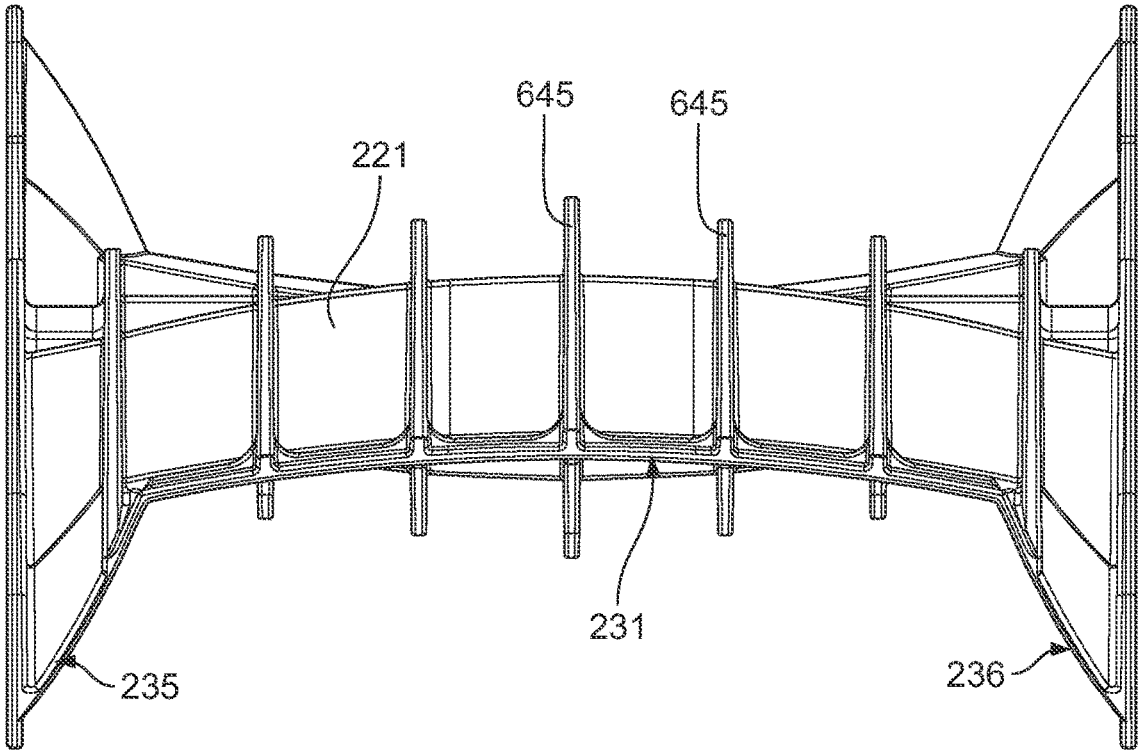
FIG. 6 is a top view of the paddle of FIG. 5.

Various views of the paddle 221 can be seen in FIGS. 2-6. In particular, FIGS. 2-3 show the paddle 221 situated in the housing 112 of the snow thrower 100. FIG. 4 shows the paddle 221 coupled with the augers 223, 225 and shaft 227. FIGS. 5-6 show additional views of the paddle 221 in isolation.

Turning to FIGS. 2-6, the paddle 221 has a throwing surface 231 that is configured to propel a charge of snow out of the intake housing 118 through the chute 116. The paddle 221 is configured to rotate around the shaft 227 such that the throwing surface 231 generally faces in the direction of rotation. The paddle 221 has rotational symmetry. In the embodiment of the figures, the paddle has two-fold rotational symmetry.

Turning to FIG. 3, the rotor assembly 121 is shown rotated around the axis defined by shaft 227, exposing a second throwing surface 331 of the paddle 221. In some examples, including the example of the FIGS., the second throwing surface 331 is substantially similar to the throwing surface 231.

As seen more clearly in FIG. 6, the throwing surface 231 can, in some examples, have a concave curvature. In alternative examples, the throwing surface does not exhibit curvature. In some examples, the throwing surfaces 231, 331 can be backward-bladed. That is, the surface of the throwing surfaces 231, 331 is not along a radius of the paddle, and is not perpendicular to the axis defined by the shaft 227, but instead is angled backwards from the direction of rotation. This can be seen more clearly in FIG. 14, which is a cutaway view of the rotor assembly 121 inside of the housing 112. The rotor assembly 121 is configured to rotate in a clockwise direction as seen from this view, and the throwing surfaces 231, 331 are angled backward, away from the direction of rotation. The angle of the backward-bladed throwing surface can be measured compared to a radius of the paddle. In one example, the angle of the throwing surface varies across the width of the throwing surface from side to side. In one example, the angle of the throwing surface ranges from 3 degrees to 20 degrees. In one example, the angle of the throwing surface ranges from 5 degrees to 17 degrees. In one example, the angle of the throwing surface is about 5 degrees at the center and about 17 degrees at the location of line 13-13 in FIG. 3. In one example, the angle of the throwing surface at the center of the throwing surface is at least 3 degrees and at most 15 degrees.

Adjacent to the throwing surface 231, the paddle 221 has a first auger extension surface 235 and a second auger extension surface 236. As can be seen in FIG. 6, the auger extension surfaces 235, 236 may be angled with respect to the throwing surface 231. In particular, the auger extension surfaces 235, 236 may each be angled inward toward the throwing surface 231. The throwing surface 231 has a width WT, illustrated in FIG. 3, defined as the width between the auger extension surfaces 235, 236. In some examples, the throwing surface 231 of the paddle 221 can have a width of at least 5 inches, at least 6 inches, at least 7 inches, and at least 8 inches. In some examples, the throwing surface 231 has a width of less than 10 inches, less than 9 inches, less than 8 inches, or less than 7 inches.

As shown more clearly in FIG. 3, the second throwing surface 331 also has a first auger extension surface 335 and a second auger extension surface 336 that are substantially similar to the auger extension surfaces 235, 236.

The paddle 221 can be constructed from a polymer material. In some examples, the polymer is constructed from a high-density polyethylene (HDPE) using a manufacturing technique such as injection molding. The paddle 221 comprises a paddle body, which may be a single injection-molded structure. In one example, the paddle includes ALATHON™ M5370 HDPE, available from LyondellBasell in North America, having a place of business in Carrollton, Texas, which is a no-break plastic at −40 degrees C. Other high-impact plastics may be used. In alternative examples, the paddle can be constructed from an ultra-high molecular weight polyethylene (UHMWPE) or very-high-molecular weight polyethylene (VHMWPE) using a manufacturing technique such as extrusion or compression molding. In addition or in the alternative, the paddle could include metal castings.

The paddle 221 is provided with through-holes 551 for attachment to the first and second augers 223, 225, and a through-hole 575 passing through the axial center of the paddle 221, where the shaft 227 sits. The paddle 221 further has openings 222 in the middle of the paddle body, allowing air and snow to pass through the center of paddle 221 near the axial center of the paddle 221. The openings 222 are separated by fin structures 645, in one embodiment.

Augers (FIGS. 2-3, 4, & 7-9)

The first and second augers 223, 225 are configured to convey snow from the outer edges of the housing 112 toward the center of the housing, where the snow is compacted into a charge that is picked up by the throwing surface 231 of the paddle 221 and expelled out the chute 116. The auger 225 can be constructed from stamped metal. The augers can be seen in FIGS. 2-4 in combination with the rotor assembly 121, and separately in FIGS. 7-9.

Referring to FIGS. 2-4, the first and second augers 223, 225 are each formed as a double helix. In the examples of the Figures, the first and second augers 223, 225 have mirror-image symmetry, with one auger having a right-hand helix, and the other auger having a left-hand helix.

The first auger 223 has a first blade 421 and a second blade 422. The second auger 225 has a first blade 451 and a second blade 452. The description of the auger blades 223, 225 will focus on the first blade 421 of the first auger 223 and the first blade 451 of the second auger 225, but these descriptions also apply to the second blade 422 of the first auger 223 and the second blade 452 of the second auger 225.

Each auger blade has a leading end that is situated near the outside edge of the housing 112, and a trailing end that is connected to the paddle 221. As can be seen in FIGS. 2 and 4, the first blade 421 of the first auger 223 has a leading end 251 that sits toward the outside edge of the housing 112, and the first blade 451 of the second auger 225 has a leading end 252 that sits toward the opposite side edge of the housing 112. In the example of the Figures, the leading ends 251, 252 are aligned with each other in their position of rotation with respect to the axis defined by the shaft 227. Thus, in use, both leading ends 251 and 252 encounter the ground at approximately the same time. In some examples, the augers are fixed to the shaft using at least one pin 482.

The first blade 421 of the first auger 223 also has a trailing end 271 that is connected to the auger extension surface 235 of the paddle 221, for example by a fastener 481. The first blade 451 of the second auger 225 has a trailing end 272 that is connected to the auger extension surface 236 of the paddle 221 by a fastener 481. In the example of the Figures, the trailing ends 271, 272 are aligned in rotation with respect to the axis defined by the shaft 227 in a similar manner as the leading ends 251, 252.

The blades of each auger combined with the auger extension surfaces of the paddle form augering portions of the rotor assembly. The augering portions have a conveying surface that serves to auger snow from the outside edge of the housing 112 toward the center, where it can be picked up by the throwing surface 231 of the paddle 221. In this way, a volume of snow is transported from an outer edge of the housing 112 and compacted to form a denser charge of snow that can be more easily expelled out the chute 116. The first blade 421 of the first auger 223 has a conveying surface 275, and the first blade 451 of the second auger 225 has a conveying surface 276. The conveying surfaces 275, 276 extend between the leading ends 251, 252 and the trailing ends 271, 272. There is an auger extension surface of the paddle 221 adjacent to each of these conveying surfaces of the augers, and the auger extension surfaces also function to convey snow to the throwing surface.

Figure 7:
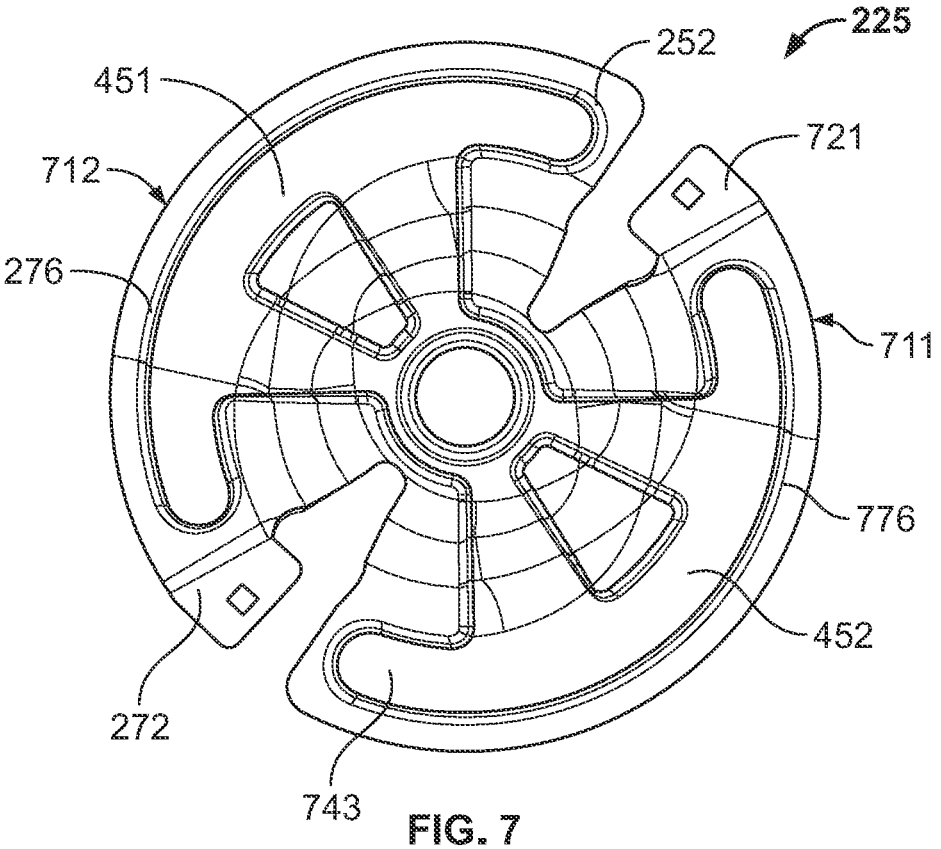
FIG. 7 is a side view of an auger for the rotor assembly.
Figure 8:
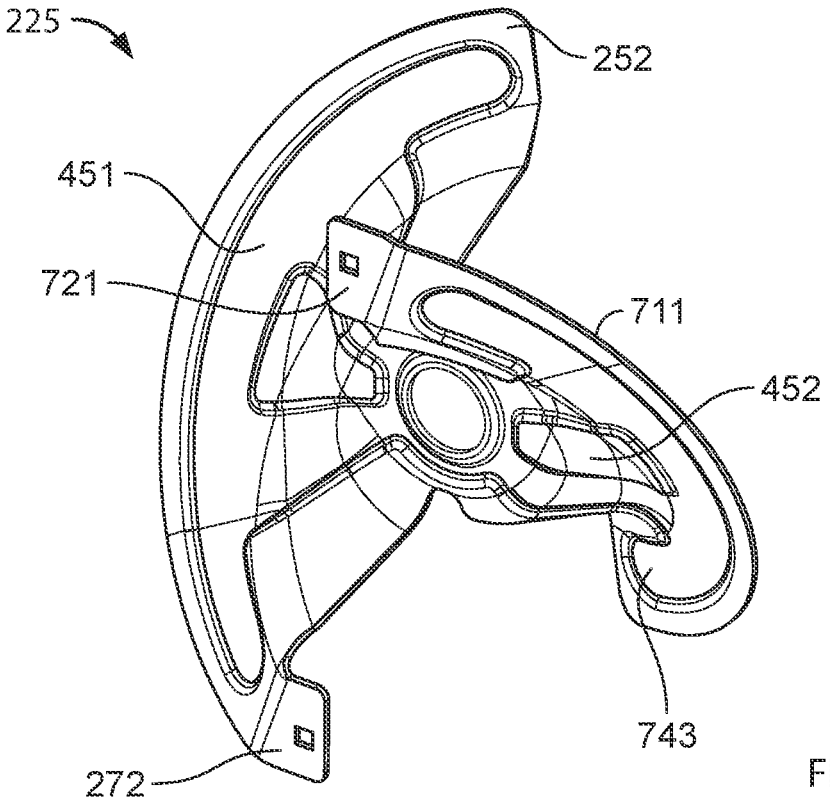
FIG. 8 is a perspective view of the auger of FIG. 7.
Figure 9:
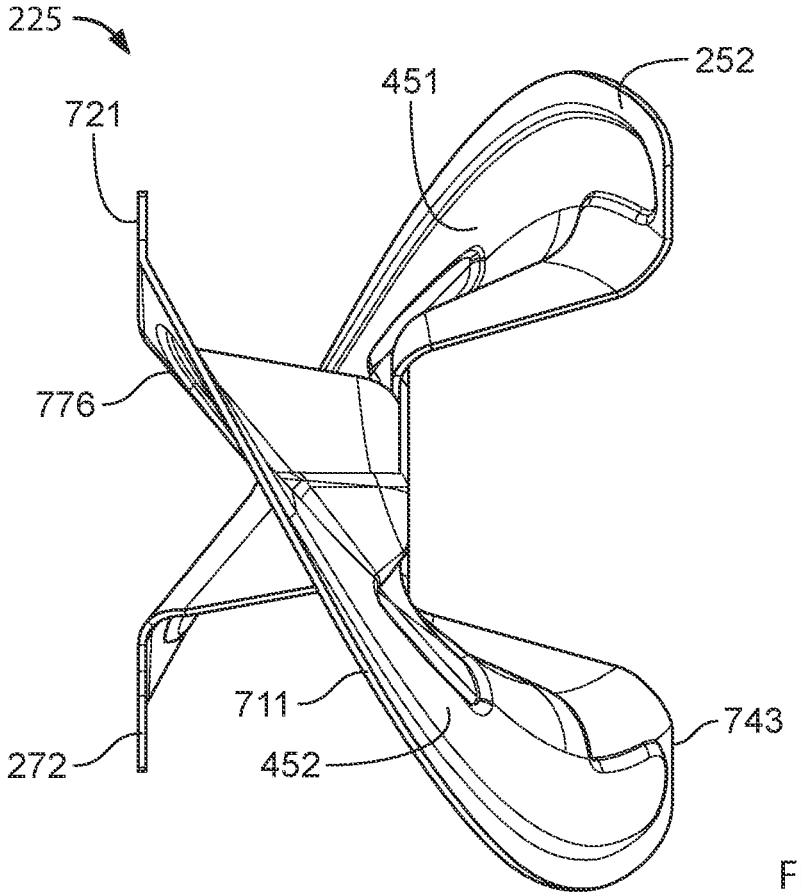
FIG. 9 is a top view of the auger of FIG. 7.

FIGS. 7-9 show the auger 225 separate from the rotor assembly 121. The auger 225 is rotationally symmetric, having a first blade 451 and a second blade 452. In the embodiments of the Figures, each auger paddle has two-fold rotational symmetry. A leading end 252 of the first blade and a leading end 743 of the second blade are configured to be positioned near an outside wall of the intake housing, and a trailing end 272 of the first blade 451 and a trailing end 721 of the second blade 452 are configured to be adjoined with the paddle 221. The blade 451 has a conveying surface 276, and the blade 452 has a conveying surface 776.

An exterior edge 712 of blade 451 and an exterior edge 711 of the blade 452 define an outer diameter of the auger 225. In the example of the Figures, the outer diameter of the auger is constant; that is, the distance of the outer edges 711, 712 from the axis defined by the shaft 227 is the same along the entire length of the edges 711, 712 from the leading end to the trailing end. In alternative examples, the outer diameter at one end of the blades could be greater or smaller than the outer diameter at the opposite end of the blades; this would create a conical-shaped auger.

The helix shape of the auger 225 has a pitch. The auger blades have a steeper pitch, with less visible surface area from a front view, than the auger blades of many current models. The pitch of the blades 451, 452 determines the angle at which the edge of the blade is incident on snow in the path of the snow thrower 100. A pitch of a blade refers to the distance between successive locations where an outer edge of the blade would intersect with a straight reference line, where the reference line is drawn between points along the outer edge of the blades. For a cylindrical auger with a constant outer diameter, the reference line is parallel to the axis of the auger. For a conical auger, the reference line will intersect the axis. The pitch of the blades 451, 452 can be expressed in inches per revolution.

In some examples, the pitch of the blades can be variable, with some portions of the blade having a steeper pitch than other portions. In the example of the Figures, the pitch of the helix as measured in inches per revolution is smaller at the ends of each auger than at the center of each auger. In the example of the Figures, the pitch of the helix near the leading ends 252, 743 is about 7 inches per revolution, the pitch at the trailing ends 272, 721 is about 8 inches per revolution, and the pitch in between the leading end and the trailing end is about 12 inches per revolution. In some examples, the pitch can be at least about 5 inches per revolution and at most about 15 inches per revolution. In some examples, the pitch can be at least about 6 inches per revolution and at most about 14 inches per revolution. In some examples, the pitch can be at least about 7 inches per revolution and at most about 13 inches per revolution.

The auger 225 has a width $W_A$, as illustrated in FIG. 3, along the axis defined as the lateral distance along the shaft 227 from the tip of the leading end 252 to the tip of the trailing end 272. In some examples, the width of the auger is at least about 3 inches and at most about 6 inches. In alternative examples, the width of the auger is at least about 3.5 inches and at most about 5.5 inches or at least about 4 inches and at most about 5.5 inches. In some examples, the width of the auger is about 4.5 inches.

Intake Housing (FIGS. 2-3 & 10-12)

Intake housing 118 is shown in FIG. 1 at the front portion of the snow thrower housing 112. The intake housing 118 houses the rotor assembly 121. FIGS. 2-3 and 10-12 show additional views of the intake housing 118. The intake housing 118 has a housing width of about 22 inches in the example of the Figures. In some examples, the intake housing 118 has a width of at least about 18 inches or at least about 20 inches. In some examples, the intake housing 118 has a width of at most about 26 inches or at least about 24 inches. The intake housing 118 can be formed of plastic or metal. The intake housing 118 can be manufactured, for example, using injection molding or other plastic molding techniques. The intake housing 118 can be manufactured using metal stamping, investment casting, or other metal forming techniques.

Figure 10:
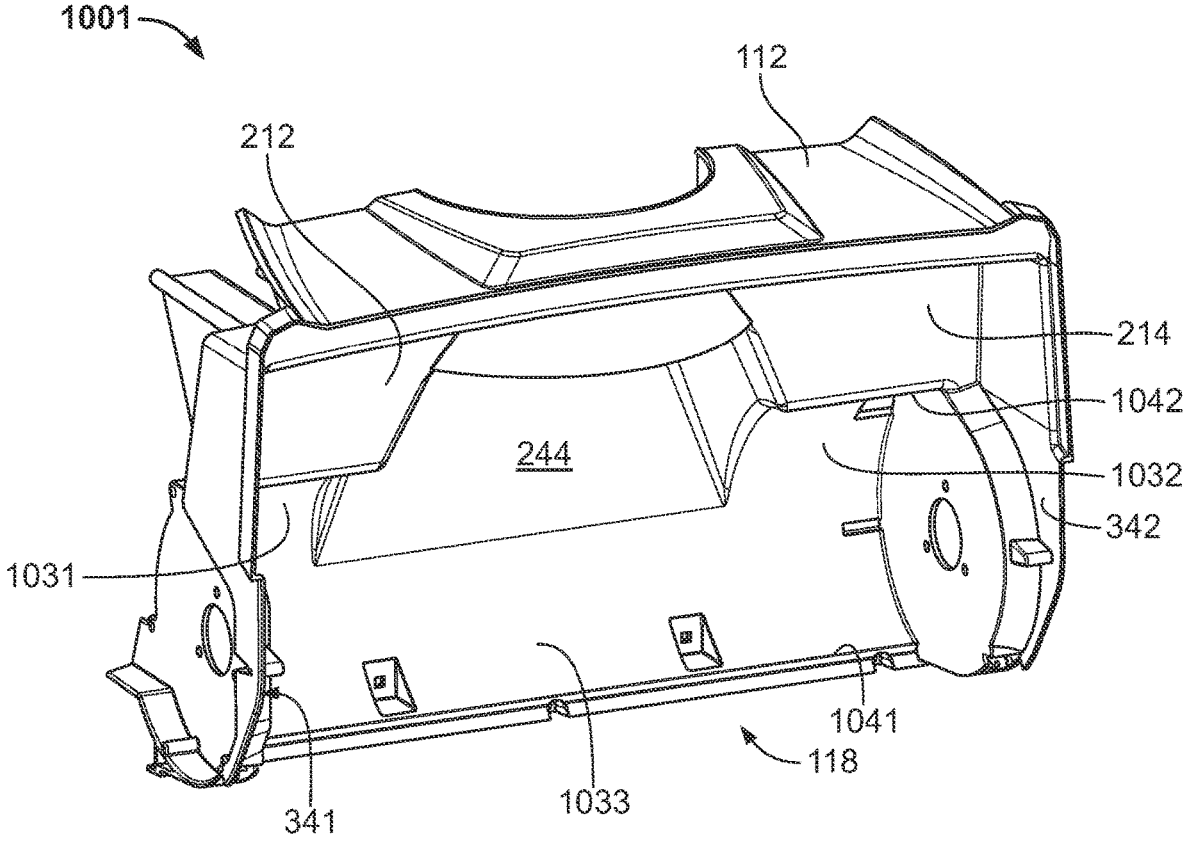
FIG. 10 is a perspective view of an intake housing according to some examples.

As shown in FIG. 10, the intake housing 118 has a first sidewall 341, and a second sidewall 342 opposite the first sidewall. Parts of the interior surface of the intake housing 118 conform to the shape of the outer diameter of the rotor assembly 121. A first interior surface portion 1031 is configured to be adjacent to the first auger 223, a second interior surface portion 1032 is configured to be adjacent to the second auger 225, and a third interior surface portion 1033 is configured to be adjacent to the paddle 221. The second interior surface portion 1032 extends from a bottom edge 1041 to a corner edge 1042 of the intake housing 118.

The first interior surface portion 1031 forms a kicker 212, which is a protrusion that curves outward from the rear wall 244 of the intake housing 118. The second interior surface portion 1032 forms a kicker 214. The kickers 212, 214 have a width $W_K$ illustrated in FIG. 3. The kicker width is measured from where the auger 223 starts at the outside edge of the auger to a tangent of a radius of a surface of the intake housing viewed from the front where the kicker 212 ends and the chamber 245 begins. The portion of the outside end of the kicker 212 that does overlap with the auger 223 is not included in the kicker width because it is not serving the function of holding a tight clearance to the auger 223. In some examples, the kickers 212, 214 have a width of at least 4 inches and at most about 7 inches; in alternative examples, the kickers 212, 214 have a width of at least about 4.5 inches and most about 6 inches. In some examples, the kickers 212, 214 have a width of about 5 inches.

Figure 11:
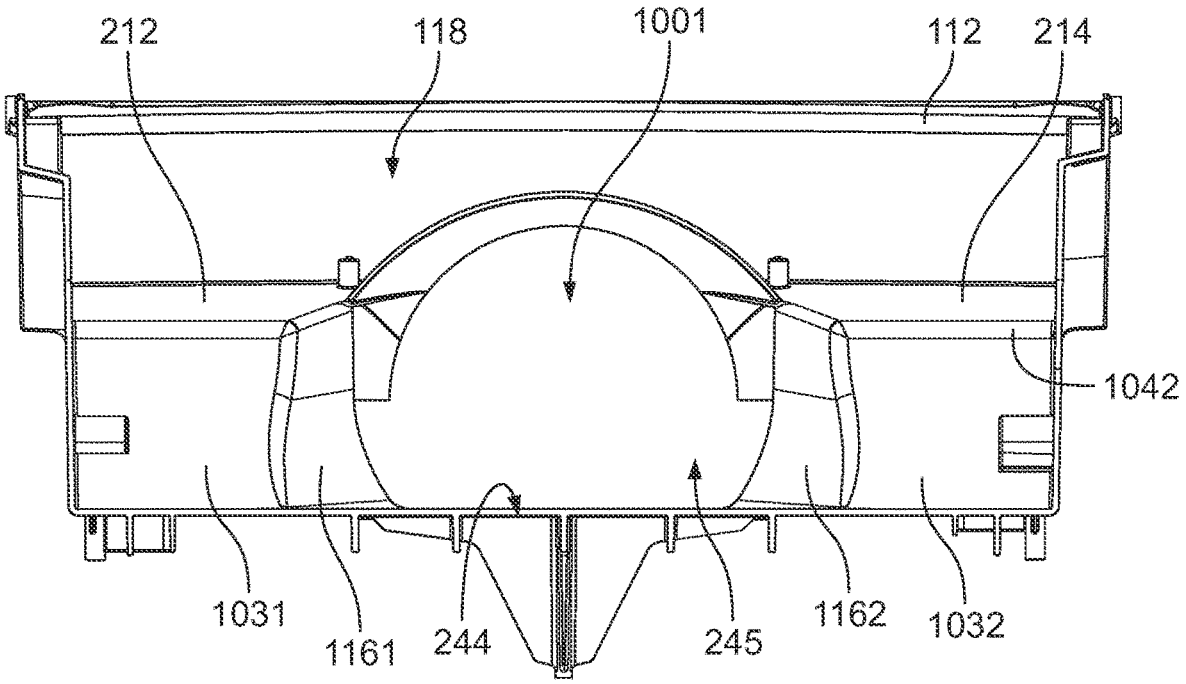
FIG. 11 is a cross-sectional view of the intake housing of FIG. 10.
Figure 12:
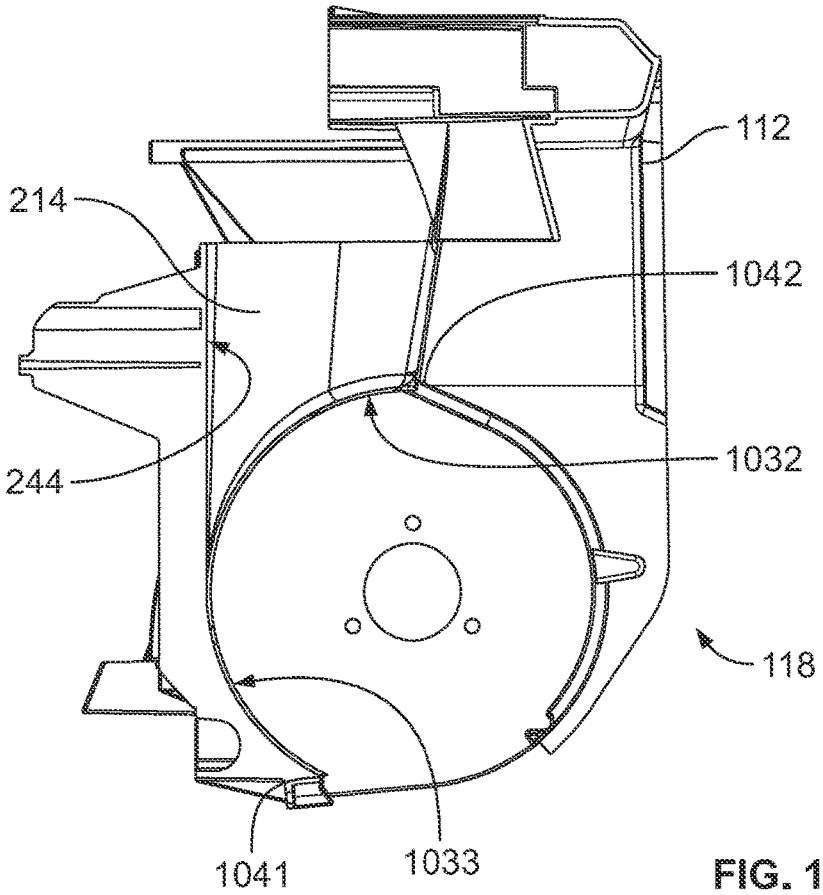
FIG. 12 is a second cross-sectional view of the intake housing of FIG. 10.

Turning to FIG. 11, between the two kickers 212, 214 is a chamber 245 that is bounded by a first chute sidewall 1161 and a second chute sidewall 1162. A chute through-hole 1001 provides a passage through which snow is discharged. A chute width is defined between the first and second chute sidewalls 1161, 1162. In some examples, the chute width as measured near its widest portion is at least about 9 inches and at most about 12 inches; in alternative examples, the widest portion of the chute is between about 10 inches and about 11 inches. In some examples, the narrowest portion of the chute is defined at the through-hole 1001, and the chute width at the through-hole is at least about 5 inches and at most about 8 inches; in alternative examples, the narrowest chute width is between about 6 inches and about 7 inches.

Figure 13:
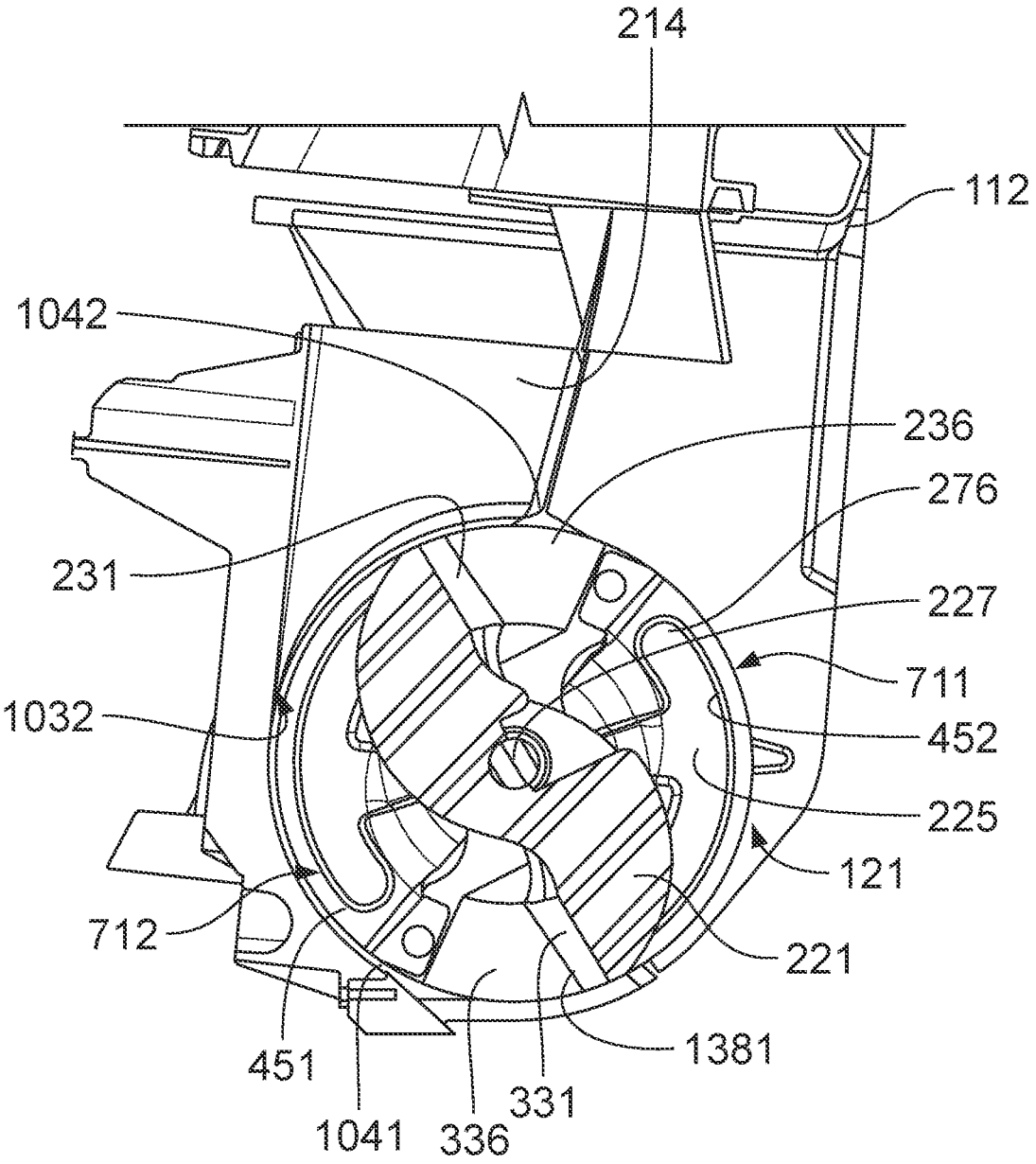
FIG. 13 is a cross-sectional view of the snow thrower and rotor according to some examples along line 13-13 of FIG. 3.

Configuration of Intake Housing in Relation to Rotor Assembly (FIGS. 2-3 & 13)

The snow thrower 100 is configured to prevent the recirculation of snow through the machine. In particular, snow is prevented from being thrown forward, outside of the intake housing 118. The geometry of the intake housing 118 in combination with the rotor assembly 121 causes snow to be augered, compacted, and thrown out of the chute, while preventing snow from being recirculated out of the intake housing 118 and back into the path of the snow thrower 100.

Turning to FIG. 13, a cross-sectional view of the snow thrower 100 is shown. The rotor assembly 121, which includes the shaft 227, the paddle 221, the first auger 223 (not seen), and the second auger 225, is situated inside of the intake housing 118 of the snow thrower housing 112. The rotor assembly 121 is configured to rotate in a clockwise direction as seen from this view.

Clearance

The outer edges 711, 712 of the auger blades 451, 452 have a tight clearance with the second interior surface portion 1032. In some examples, the outer edges 711, 712 have a clearance of about less than 1 cm from the interior surface portion 1032. In alternative examples, the outer edges 711, 712 have a clearance of about less than 0.5 centimeters from the interior surface portion 1032. In some examples, the clearance between the outer edges 711, 712 and the interior surface portion 1032 is approximately 0.1 inch (approximately 0.25 cm). The outer edges of the auger blades of the first auger 223 (not seen in FIG. 13) can have the same clearance from the first interior surface portion 1031.

Similarly, the outer diameter of the paddle 221 has a tight clearance with the interior surface portion 1033 (seen in FIGS. 10 and 12), and the clearance between the paddle 221 and the surface portion 1033 can be about less than 1 cm, about less than 0.5 cm, or approximately 0.1 inch (approximately 0.25 cm). In some examples, the outer diameter of the auger 225 is approximately the same as the outer diameter of the paddle 221. In alternative examples, the outer diameters could be different from each other.

Sweep

The tight clearance between the interior surface of the intake housing 118 and the outer edges of the auger 225 are maintained across a particular sweep of rotation. As used herein, "sweep" refers to a degree of rotation of the rotor assembly around the axis defined by the shaft 227. In some examples, the tight clearance between the interior surface portion 1032 and the outer edges of the auger 225 is maintained across a sweep of at least 120 degrees; for example, any given point on the outer edge 712 of the blade 451 remains within a distance of 1 cm or less from the surface portion 1032 through at least 120 degrees of rotation of the rotor assembly 121. In some examples, the tight clearance is maintained across a sweep of at least 130 degrees, 140 degrees, 150 degrees, or 160 degrees. In the example of FIG. 13, the auger 225 maintains the tight clearance across a sweep of approximately 150 degrees. This is demonstrated in FIG. 14, which shows that line A drawn from the center of the axis to the corner edge 1042 and line B drawn from the center axis to the bottom edge 1041 meet at an angle of about 150 degrees.

Degrees of Helix of the Auger

As used herein, "degree of helix" refers to the degrees of rotation the auger travels around the axis of the shaft from the beginning of the auger helix near the outside edge of the auger to the end of the auger helix, where the auger helix meets the paddle. This can be visualized by, in an end view or cross-sectional view of the rotor assembly, such as FIG. 15, drawing a first line C between the leading end 252 of the auger 225 and the axis, and a second line D between the top edge of the throwing surface 231 of the paddle 221 and the axis. The angle between the two lines is the degree of helix.

Figure 14:
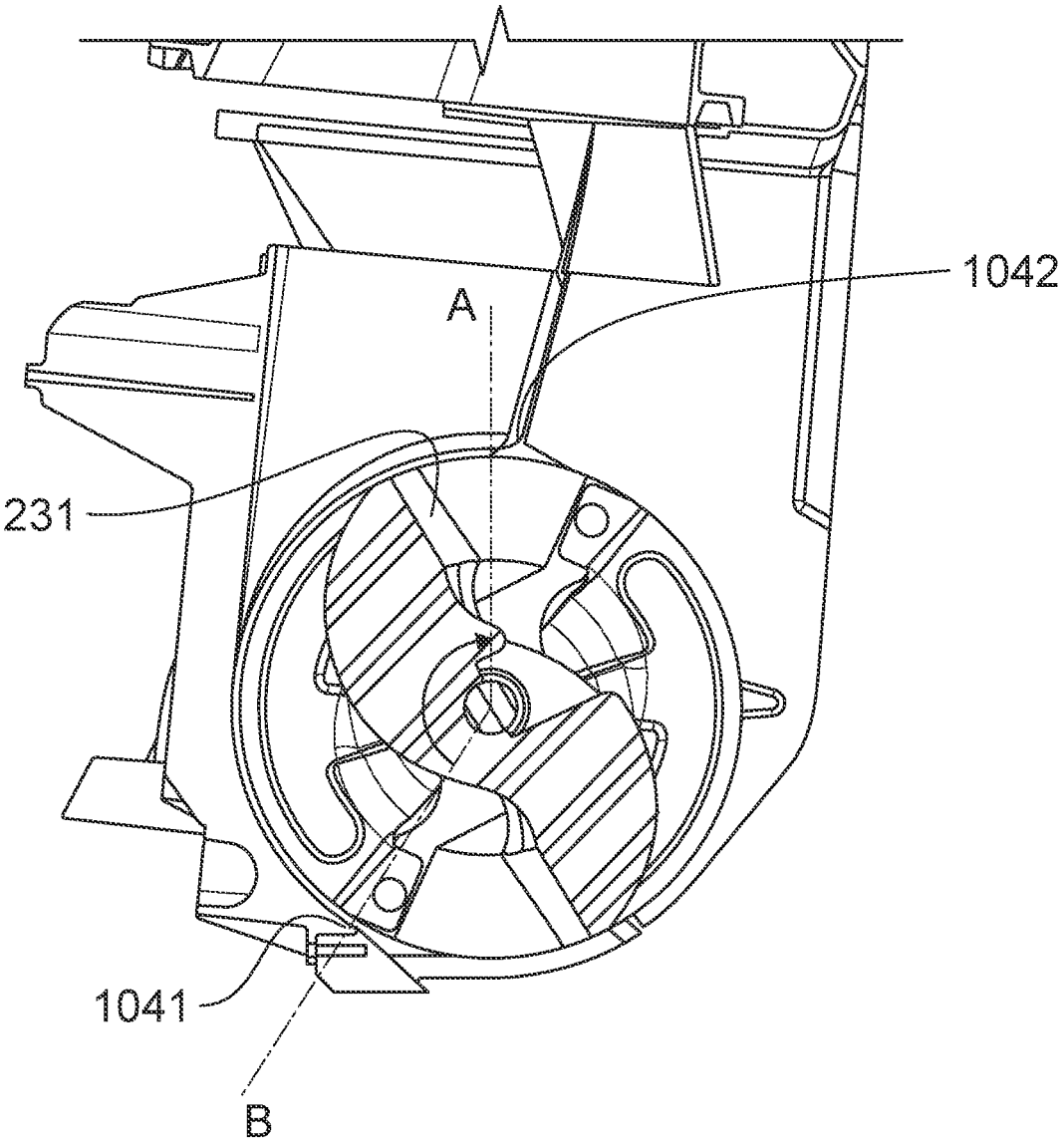
FIG. 14 is the cross-sectional view of FIG. 13 demonstrating angles of sweep.
Figure 15:
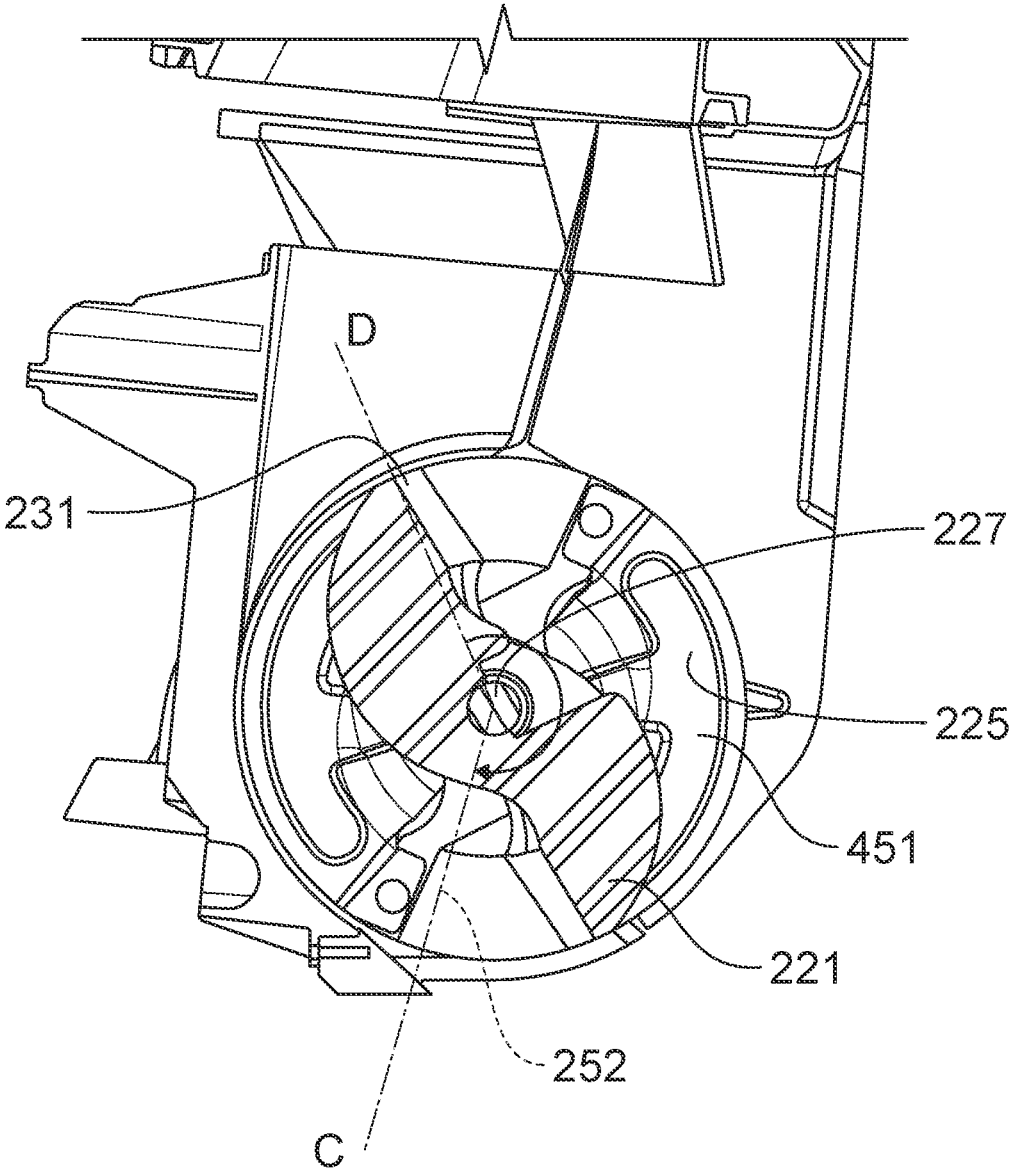
FIG. 15 is the cross-sectional view of FIG. 13 demonstrating degree of helix.

As can be best seen in FIGS. 4-6, the throwing surface 231 is a curved surface. FIGS. 13-15 are cross-sectional views along line 13-13 of FIG. 3 and cross-hatching on the paddle 221 and the shaft illustrate where they intersect with the plane of the cross-section. As a result, the cross-sectional view of FIGS. 13-15 illustrates the location of the throwing surface 231 at the particular location of line 13-13, but does not illustrate where the helix of the auger meets the paddle, because that location is behind the plane of the cross-section and is hidden by the paddle 221. Line D in FIG. 15 is therefore an approximation of where the auger 225 meets the paddle 221. Also, the leading end 252 is hidden in FIG. 15 and is therefore represented by a dashed line. Leading end 252 can be seen in FIGS. 7-9.

The degree of helix for the rotor assembly 121 corresponds to the amount of rotation that the rotor assembly 121 travels around its axis between where the leading end 252 of auger 225 encounters a reference angle, for example, normal to the ground (i.e., a 90 degree angle to the ground), to where the throwing surface 231 reaches the reference angle. Because the throwing surface 231 is backward-bladed and curved, describing when the throwing surface reaches a reference angle can be complicated. Line D is drawn to the top edge of the throwing surface 231 that is in the plane of the cross-section, and can be used to measure the angle of the throwing section in a particular cross-sectional view. It has been found that a larger degree of helix produces a decrease in the amount of snow recirculation, thus improving the efficiency of the rotor.

In some examples, such as that of FIG. 13, the degree of helix of the rotor 121 is provided by a conveying surface that extends across both a portion of the auger surface 276 of the auger 225 and the auger extension surface 236 of the paddle 221. In other examples, the rotor's auger could adjoin the throwing surface of the paddle without incorporating an auger extension surface on the paddle. In either case, the conveying surface of the rotor 121 meets the throwing surface 331 at an angled edge 1381.

In some examples, the conveying surface of the rotor 121 has a width along the axis of the shaft 227 of at least 4 inches. In alternative examples, the width of the conveying surface is at least 5 inches, at least 6 inches, at least 7 inches, or at least 8 inches. In some examples, the width of the conveying surface of the rotor 121 is at most 9 inches, at most 8 inches, at most 7 inches, or at most 6 inches.

In the example of FIG. 15, the rotor defines approximately 210 degrees of helix between lines C and D.

Interaction Between Rotor Degree of Helix, Kicker Sweep, and Kicker Width

It has been found that a relatively large degree of helix of the rotor assembly combined with a relatively large degree of kicker sweep reduces snow recirculation. In some examples, a degree of helix greater than 180 degrees, combined with a kicker sweep of greater than 120 degrees, decreases snow recirculation. In alternative examples, a degree of helix of greater than 190 degrees, greater than 200 degrees, greater than 210 degrees, or greater than 220 degrees can be combined with a kicker having any one of the following kicker sweeps to reduce snow recirculation: greater than 130 degrees, greater than 140 degrees, greater than 150 degrees, and greater than 160 degrees. In the example of the Figures, the degree of helix of the rotor assembly 121 is approximately 210 degrees, and the degree of sweep of the kickers is approximately 150 degrees. Thus, some combinations of degree of helix added to the degree of sweep of the kickers will equal about 360 degrees.

Furthermore, an increased ratio of the kicker width to auger width also produces less snow recirculation. A narrower kicker with a smaller ratio of kicker width to auger width will cause some snow to remain on the conveying surface. In that case, snow that remains on the conveying surface will not be thrown out the chute, but will instead be thrown forward. A wider kicker that has a tight clearance with the auger forces snow to remain on the conveying surface for a larger degree of sweep, allowing the snow to compact for a longer period of time and producing a relatively denser charge of snow. In some examples, the kickers have a width $W_K$ of at least 75% of the width $W_A$ of the auger. In alternative examples, the kickers have a width that is 80%, 85%, 90%, or 95% the width of the auger. In some examples, the kicker width is at least about 90% of the auger width. In one example, the kicker width is about 88% of the auger width. In some examples, the kicker width that is about 100% of the auger width. In some examples, the kicker width is at most 100% of the auger width. In some examples, the kicker width is at least about 90% and at most 100% of the auger width.

Alternative Example of a Rotor Assembly for a Snow Thrower

Figure 16:
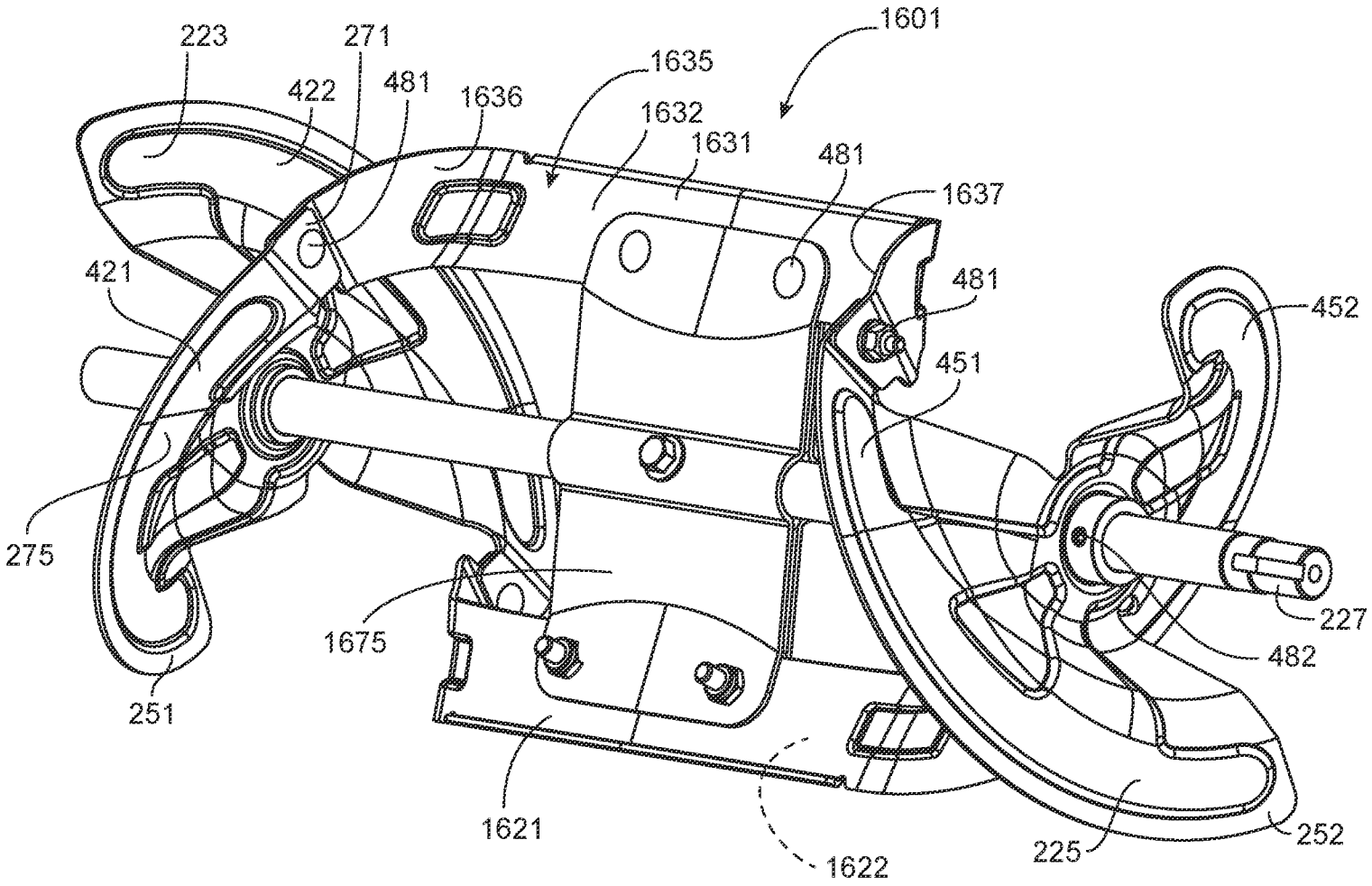
FIG. 16 is a perspective view of a rotor assembly according to some alternative examples.

FIG. 16 shows an alternative example of a rotor assembly for snow thrower. The rotor assembly 1601 includes first and second augers, which can be the augers 223 and 225 described above. The rotor assembly 1601 includes a paddle 1635 that includes a first throwing member 1631 and a second throwing member 1621 that couple with the augers 223, 225. In some examples, the first and second throwing members 1631, 1621 are made of a metal material. The first and second throwing members 1631, 1621 can be made of stamped metal, for example. Throwing member 1631 is coupled with auger 223 and the auger 225 with fasteners 481.

The paddle 1635 is configured to rotate around the shaft 227 such that the throwing member 1631 generally faces in the direction of rotation. The paddle 1635 has a two-fold rotational symmetry. The throwing members 1631, 1621 are configured to propel a charge of snow out of the intake housing 118 through the chute 116.

As in the previous examples described in relation to FIGS. 1-15, the throwing member 1631 can have a concave curvature. In some examples, the curvature of the throwing member 1631 is substantially similar to the curvature of the throwing surface 231 described in relation to FIGS. 2-6. Likewise, the throwing member 1621 can have a concave curvature similar to the curvature of throwing surface 331. The throwing members 1631, 1621 can be backward bladed, similar to the example shown in FIG. 14. In the example of FIG. 16, the throwing member 1631 has a throwing surface 1632. The throwing member 1621 also includes a throwing surface 1622 (facing away from the viewer in FIG. 16). The curvatures and angles of the throwing surfaces 1622, 1632 can be similar to the angles and curvature described in relation to the throwing surfaces 231, 331.

Adjacent to the throwing surface 1632 is a first auger extension surface 1636 and a second auger extension surface 1637. The auger extension surfaces 1636, 1637 may each be angled inward toward the throwing surface 1631. The throwing surface 1631 can have a width similar to the throwing surface 231 described in relation to FIG. 3. The throwing surface 1622 also includes first and second auger extension surfaces, similar to those of the second throwing surface 331.

The paddle 1635 includes a connecting plate 1675 that is fixedly attached to the shaft 227 such that the connecting plate 1675 rotates in synchronization with the shaft 227. The connecting plate 1675 is fixedly attached to the first throwing member 1631 and the second throwing member 1621 by a plurality of fasteners 481.

The rotor assembly 1601 can be used with the snow thrower 100 to prevent recirculation of snow through the machine. As with the example of rotor assembly 121, described above, the geometry of the intake housing 118 in combination with the rotor assembly 1601 causes snow to be augered, compacted, and thrown out of the chute, while preventing snow from being recirculated out of the intake housing 118 and back into the path of the snow thrower 100.

In the example shown in FIG. 16, the auger blades 451, 452 can have tight clearance with the interior surfaces of the intake housing. The outer diameter of the paddle 1635 can have a tight clearance with the interior surface portion of the intake housing, similar to the example described above in relation to rotor assembly 121. The discussion above regarding the interaction between rotor degree of helix, kicker sweep, and kicker width can similarly be implemented using the rotor assembly 1601. Thus, the interaction between the rotor assembly 1601 and the snow thrower housing produces less snow recirculation, as described above in relation to FIGS. 2-15.

It should be noted that, as used in this specification and the appended claims, the singular forms include the plural unless the context clearly dictates otherwise. It should also be noted that the term "or" is generally employed in its sense including "and/or" unless the content clearly dictates otherwise.

All publications and patent applications referenced in this specification are herein incorporated by reference in their entirety.

The invention has been described with reference to various specific and preferred embodiments and techniques. However, it should be understood that many variations and modifications may be made while remaining within the spirit and scope of the invention.

What is claimed is:

1. A snow thrower comprising:

a rotor assembly having a first auger, a second auger, and a paddle disposed between the first and second augers, the rotor assembly fixed to a shaft and the shaft configured to rotate around an axis;

an intake housing having a first interior surface adjacent to the first auger and a second interior surface adjacent to the second auger, the intake housing further comprising a first kicker and a second kicker defining a chute opening therebetween, the chute opening having a width greater than a width of a throwing surface of the rotor assembly;

wherein an outer edge of the first auger has a clearance of less than 1 centimeter from the first interior surface, wherein the first interior surface extends from a bottom edge to a corner edge of the intake housing, and an outer edge of the second auger has a clearance of less than 1 centimeter from the second interior surface, wherein the second interior surface extends from a bottom edge to a corner edge of the intake housing.

2. The snow thrower of claim 1, wherein the intake housing further comprises a third interior surface portion adjacent to the paddle, wherein the outer diameter of the paddle has a clearance of less than 1 centimeter from the third interior surface.

3. The snow thrower of claim 1, wherein a width of the first auger is greater than a width of the first kicker and a width of the second auger is greater than a width of the second kicker.

4. The snow thrower of claim 3, wherein a ratio of the first kicker width to the first auger width is at least 0.75 and a ratio of the second kicker width to the second auger width is at least 0.75.

5. The snow thrower of claim 1, wherein the rotor assembly provides a degree of helix of greater than 180 degrees.

6. The snow thrower of claim 1, wherein the first interior surface and the second interior surface are cylindrical.

7. The snow thrower of claim 1, wherein the first and second augers each have a first blade and a second blade forming a double helix.

8. The snow thrower of claim 1, wherein the first and second augers are metal, wherein the paddle comprises a paddle body extending from the shaft to a mid-point of a throwing surface.

9. The snow thrower of claim 1, wherein the first auger has a first blade and a second blade defining a double helix, the paddle has a first throwing surface and a second throwing surface, and wherein the first blade of the first auger is attached to the first throwing surface and the second blade of the first auger is attached to the second throwing surface.

10. A snow thrower comprising:

a rotor assembly having a first auger, a second auger, and a paddle disposed between the first and second augers, the rotor assembly fixed to a shaft and the shaft configured to rotate around an axis;

an intake housing having a first interior surface adjacent to the first auger and a second interior surface adjacent to the second auger, the intake housing further comprising a first kicker and a second kicker defining a chute opening therebetween, wherein an outer edge of the first auger has a clearance of less than 1 centimeter from the first interior surface across a sweep of at least 120 degrees, and an outer edge of the second auger has a clearance of less than 1 centimeter from the second interior surface across a sweep of at least 120 degrees.

11. The snow thrower of claim 10, wherein the first interior surface extends from a bottom edge to a corner edge of the intake housing, wherein the second interior surface extends from a bottom edge to a corner edge of the intake housing.

12. The snow thrower of claim 11, wherein the intake housing further comprises a third interior surface portion adjacent to the paddle, wherein the outer diameter of the paddle has a clearance of less than 1 centimeter from the third interior surface.

13. The snow thrower of claim 12, wherein a ratio of the first kicker width to the first auger width is at least 0.75 and a ratio of the second kicker width to the second auger width is at least 0.75.

14. The snow thrower of claim 13, wherein the chute opening having a width greater than a width of a throwing surface of the rotor assembly.

15. The snow thrower of claim 14, wherein the intake housing has a clearance of less than 0.5 centimeters from the outer diameter of the first and second augers through at least 120 degrees of rotation of the rotor assembly.

16. The snow thrower of claim 15, wherein the rotor assembly provides a degree of helix of greater than 180 degrees.

17. The snow thrower of claim 16, wherein the first interior surface and the second interior surface are cylindrical.

18. The snow thrower of claim 17, wherein the first and second augers each have a first blade and a second blade forming a double helix.

19. A snow thrower comprising:

an intake housing comprising a first kicker and a second kicker defining a chute opening therebetween; and a rotor assembly having a first auger, a second auger, and a paddle disposed between the first and second augers, the rotor assembly fixed to a shaft and the shaft configured to rotate around an axis;

wherein the paddle comprises:

a throwing surface;

a first opening configured to receive the first auger; and a second opening configured to receive the second auger;

the first auger having a leading end adjacent to a first side of the intake housing, a trailing end adjoining the throwing surface, and a conveying surface extending between the leading end and the trailing end; and the second auger having a leading end adjacent to a second side of the intake housing, a trailing end adjoining the throwing surface, and a conveying surface extending between the leading end and the trailing end.

20. The snow thrower of claim 19, wherein the first and second kickers define protrusions curving outwards from a rear wall of the intake housing, the intake housing having a first interior surface adjacent to the first auger and a second interior surface adjacent to the second auger, wherein an outer edge of the first auger has a clearance of less than 1 centimeter from the first interior surface across a sweep of at least 120 degrees, and an outer edge of the second auger has a clearance of less than 1 centimeter from the second interior surface across a sweep of at least 120 degrees.

* * * * *